US006205618B1

(12) United States Patent
Lee

(10) Patent No.: US 6,205,618 B1
(45) Date of Patent: Mar. 27, 2001

(54) HINGE

(75) Inventor: Chariot Lee, Miao-Li (TW)

(73) Assignee: Mustek Systems, Inc., Hsinchu (TW)

( * ) Notice: Subject to any disclaimer, the term of this patent is extended or adjusted under 35 U.S.C. 154(b) by 0 days.

(21) Appl. No.: 09/350,114

(22) Filed: Jul. 9, 1999

(51) Int. Cl.[7] ..... E05D 7/10

(52) U.S. Cl. ..... 16/256; 16/260; 16/267; 16/268

(58) Field of Search ..... 16/256, 260, 257, 16/259, 268, 267

(56) References Cited

U.S. PATENT DOCUMENTS

| | | | | |
|---|---|---|---|---|
| 655,606 | * | 8/1900 | Clark | 16/260 |
| 719,137 | * | 1/1903 | Preston | 16/256 |
| 745,887 | * | 12/1903 | McCready | 16/256 |
| 847,963 | * | 3/1907 | Milhollin | 16/16 |
| 1,172,500 | * | 2/1916 | Taylor | 16/256 |
| 1,484,372 | * | 2/1924 | Edwards | 16/256 |
| 2,443,515 | * | 6/1948 | Rockwell | 16/267 |
| 2,920,341 | * | 1/1960 | Amstutz | 16/260 |
| 3,141,190 | * | 7/1964 | Reiss | 16/260 |

* cited by examiner

*Primary Examiner*—Chuck Y. Mah
(74) *Attorney, Agent, or Firm*—Bacon & Thomas

(57) ABSTRACT

The invention relates to a hinge for connecting any two separate apparatuses that rotates around a common axis. Advantages of the proposed hinge comprise simple combination process, secured structure and no assistant tool is required. The proposed hinge comprises a first pair of structures, a second pair of structures and a torsional spring, where first pair of structures is fixed in one apparatus and second pair of structures is fixed in another apparatus. Moreover, the torsional spring connects both apparatuses. The combination process of the proposed hinge is that two separate apparatuses are initially connected by the torsional spring when the torsional spring is not compressed or elongated, then these apparatuses are rotated around the common axis until first pair of structures is directly coupled with second pair of structures. Where coupling interaction is provided by a hook of first pair of structures hooking on edge of a concave portion of second pair of structures when first pair of structures is pushed by a bulge of second pair of structures. Obviously, the combination process is simple and no assistant tool is required. Beside, owing to the fact that the torsional spring is compressed when the hinged is opened, it is obvious that first pair of structures is securely coupled with second pair of structures by opposite direction elastic force of compressed torsional spring.

14 Claims, 3 Drawing Sheets

HINGE

BACKGROUND OF THE INVENTION

1. Field of the Invention

The present invention relates to a hinge for connecting two separate apparatuses, and more particularly to a hinge that not only has simple combination process and secured structure but also does not require any assistant tool.

2. Description of the Prior Art

Hinge is used to connect two separate apparatus that share a common axis, and is widespread used in modern industry and daily life. Possible applications comprise door hinge, journal box hinge, gear ox cover hinge and so on.

Conventional structure of hinge, as shown in FIG. 1, is essentially formed by torsional spring 10 that one end of torsional spring 10 locates on apparatus 12 and another end of torsional spring 10 locates on apparatus 14, where apparatus 12 and apparatus 14 shares common axis 16 and shapes of both apparatuses 12/14 are unrestricted.

In general, when hinge is formed and opened, then apparatus 12 and apparatus 14 are pre-transfigured with a specific angle and torsional spring 10 is compressed. Where obstruction 18 is formed on axis 16 to prevent apparatus 12 and apparatus 14 are separated by elastic force of compressed torsional spring 10. Furthermore, when hinge is closed torsional spring 10 is further compressed, then opposite direction torque that induced by further compressed torsional spring 10 will pull hinge back to initial state when external force is vanished.

Obviously, conventional structure of hinge is simple and useful. No matter how, combination process of conventional structure of hinge is strenuous for torsional spring 10 must be pre-transfigured to the specific angle before two ends of torsional spring 10 are located on apparatus 12 and apparatus 14. Beside, owing to the fact that apparatus 12, apparatus 14, axis 16, and obstruction 18 should be assembled in a specific configuration with the specific angle before they are connected to each other. It is obvious that assistant tools are required to fix position of each component part and compress spring 10.

According to previous discussion, it is obvious that structure and combination process of conventional hinge are not perfect, and then it is desired to develop an improved structure of hinge that not only provides simple combination process and secured structure but also saves the requirement of assistant tools.

SUMMARY OF THE INVENTION

The main objective of the present invention is to mitigate and/or obviate these previously described disadvantages in the manner set forth in the following description of these preferred embodiments.

A primary object of the present invention is to present a hinge that reduce combination cost by saving the requirement of assistant tools.

Another objective of the present invention is to provide a hinge that simplifies combination process of hinge.

A further objective of the invention is to afford a hinge with a securely structure.

These component parts of the provided hinge comprise a first pair of structures, a second pair of structures and a torsional spring.

Moreover, these component parts of the provided invention have following characteristics:

(1) First pair of structures is fixed on one apparatus, and second pair of structures is fixed on another apparatus.

(2) One pair of structures locates inside another pair of structures.

(3) One bulge locates on one structure of first pair of structures, the bulge is adjacent to second pair of structures.

(4) One concave portion locates on edge of another structure of first pair of structures.

(5) One hook locates on a specific structure of second pair of structures, the specific structure is adjacent to the structure with concave portion.

(6) One end of the torsional spring locates on one apparatus or first pair of structures, another end of the torsional springs locates on another apparatus or second pair of structures.

The combination process of the provided invention can briefly illustrated by following descriptions.

First, torsional spring is coupled with two apparatuses when torsional spring is not transfigured. until first pair of structures is securely coupled with second pair of structures by the hook directly hooking edge of the concave portion.

Further objectives and advantages of the present invention will become apparent as the following description proceeds and the features of novelty which is characterized in these claims annexed to and forming a part of the invention.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

In order to elucidate these objects of the proposed hinge, some figures are employed to illustrate the invention and are explained in following paragraphs.

Figure 1:
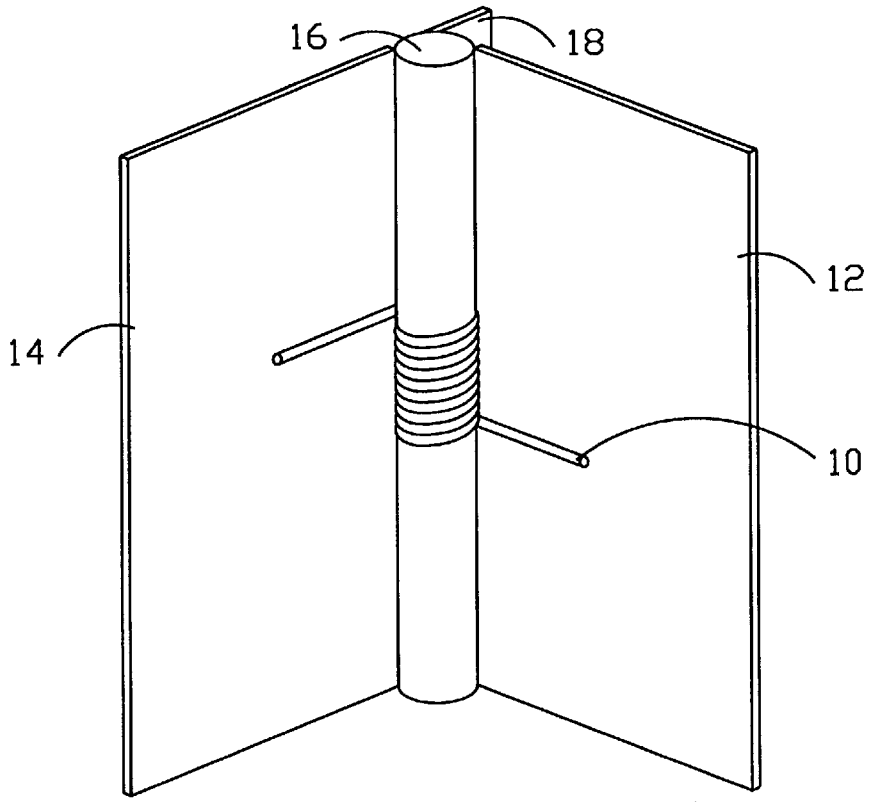
FIG.1(Prior Art)
FIG. 1 briefly illustrates structure and application of a conventional hinge.
Figure 2:
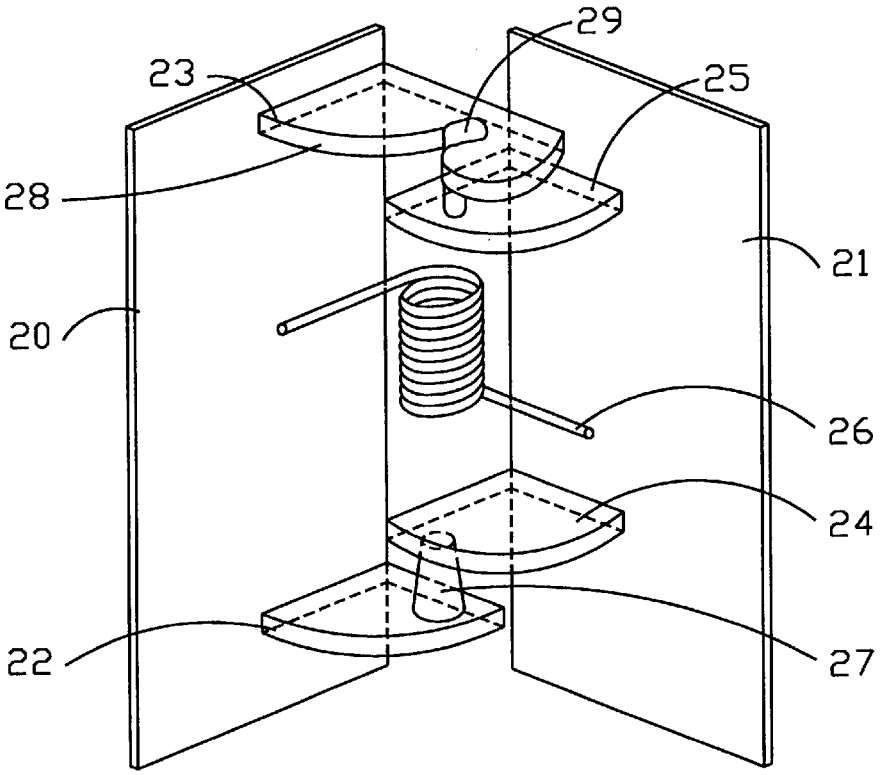
FIG. 2 briefly illustrates structure and application of one embodiment of the present hinge.

Referring to FIG. 2, structure and application of a present hinge is briefly illustrated when the present hinge is opened. The present hinge is used to connect apparatus 20 and apparatus 21, where apparatus 20 and apparatus 21 are separated and rotates around a common axis. First structure 22 and second structure 23 form first pair of structures and an end of first pair of structures is fixed in first apparatus 20 such that the first pair of structures and first apparatus 20 forms a rigid body. Third structure 24 and fourth structure 25 form second pair of structures and an end of second pair of structures is fixed in second apparatus 21 such that the second pair of structures and second apparatus 21 forms another rigid body. Moreover, second pair of structures locates between first structure 22 and second structure 23. Additional, first structure 22 could be inlayed in first apparatus 20 or be molded integrally with first apparatus 20, second structure 22 could be inlayed in second apparatus 21 or be molded integrally with second apparatus 21.

Consequentially, one end of torsional spring 26 is fixed in first structure 22, second structure 23 or first apparatus 20; and another end of torsional spring 26 is fixed in third structure 24, fourth structure 25 or second structure 21. Moreover, because the first pair of structures and first apparatus 20 forms a rigid body and the second pair of structures and second apparatus 21 forms another rigid body, the transmutation of torsional spring 26 is independent on where torsional spring 26 is attached.

Beside, bulge 27 locates on a specific surface of first structure 22, where the specific surface faces second structure 23 and directly contacts with third structure 24. Concave portion 28 locates on edge of second structure 23 and hooked by hook 29, where hook 29 locates on fourth structure 25.

Although only opened state of proposed hinge is illustrated in FIG. 2, it is crystal-clear that when proposed hinge is closed then first apparatus 20 and second apparatus 21 are moved to each other. Obviously, torsional spring 26 will be further compressed and third structure 24 always directly contacts bulge 27. Incidentally, hook 29 may moves along edge of second structure 23 and then concave portion 28 of second structure 23 maybe does not be hooked by hook 29. No matter how, the detail relation between hook 29 and concave portion 28 of second structure 23 is decided by configuration of said hinge.

Figure 3A:
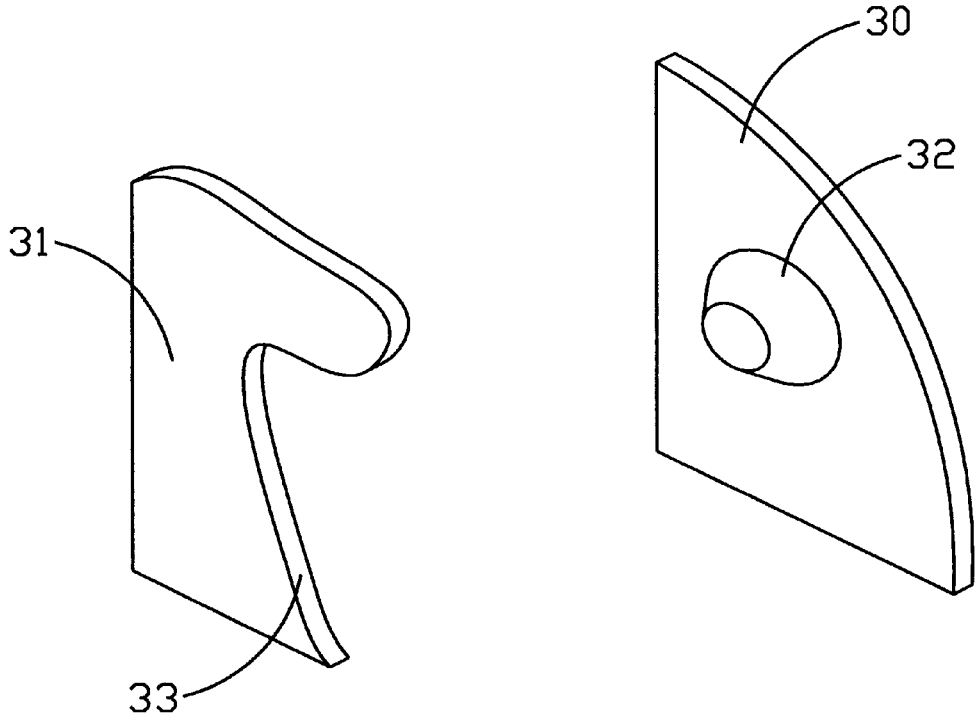
FIG. 3A to FIG. 3B briefly illustrate characteristics of structure of one embodiment of present hinge.
Figure 3B:
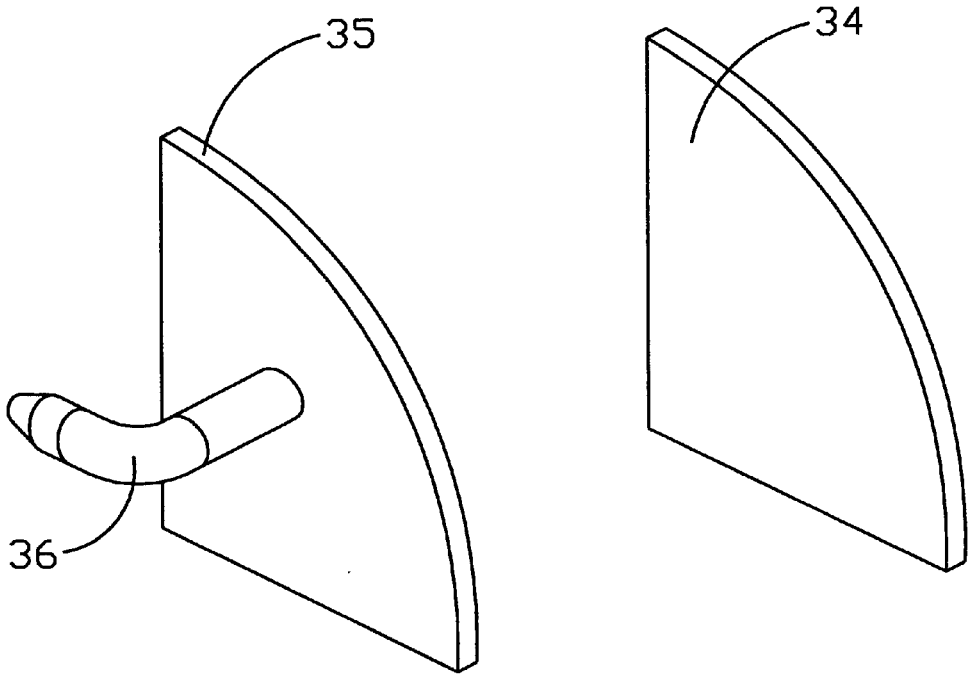

In order to elucidate characteristics of structure of the present hinge, FIG. 3A illustrates the first pair of structures and FIG. 3B illustrates the second pair of structures. It should be noted that though shape of any structure briefly is quarter-circle in the embodiment, the shape of any structure of the invention is not restricted by the proposed embodiment.

As FIG. 3A shows, first pair of structures is formed by first structure 30 and second structure 31, bulge 32 locates on a surface of first structure 30 where the surface faces second structure 31, and concave portion 33 locates on edge of second structure 31. Moreover, thickness of first structure 30 is d1, thickness of second structure 31 is d2 and height of bulge 32 is h1. Moreover, distance between first structure 30 and second structure 31 is L1.

As FIG. 3B shows, second pair of structures is formed by third structure 34 and fourth structure 35. Moreover, second pair of structures locates between first structure 30 and second structure 31. In addition, hook 36 locates on fourth structure 35 and is adjacent to second structure 31. Herein, thickness of third structure is d3, thickness of fourth structure is d4, height of hook 36 is h2 and distance between third structure 34 and fourth structure 35 is L2.

Because hook 36 is used to hook second structure 31, h2 must be larger than d2. Moreover, Because third structure 34, fourth structure 35 and hook 36 all locate between first structure 30 and second structure 31 before bulge 32 directly contacts with third structure 34 and pushes third structure 34 away from first structure 30, it is indisputable that L1 must be larger than summation of h2, d3, d4 and L2. Beside, position of hook 36 usually is corresponding to position of concave portion 33 and position of bulge 32. Of course, hook 36, concave portion 33 and bulge 32 do not need always arrange along a straight line, And these detail relations between hook 36, concave portion 33 and bulge 32 depend on configuration of said hinge.

Figure 4A:
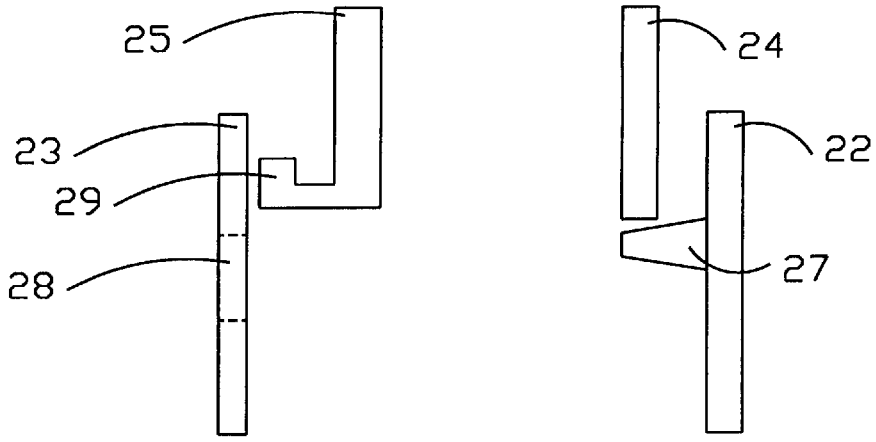
FIG. 4A to FIG. 4C briefly illustrate cross-section view of the present hinge, where torsional spring of the proposed hinge is omitted.
Figure 4B:
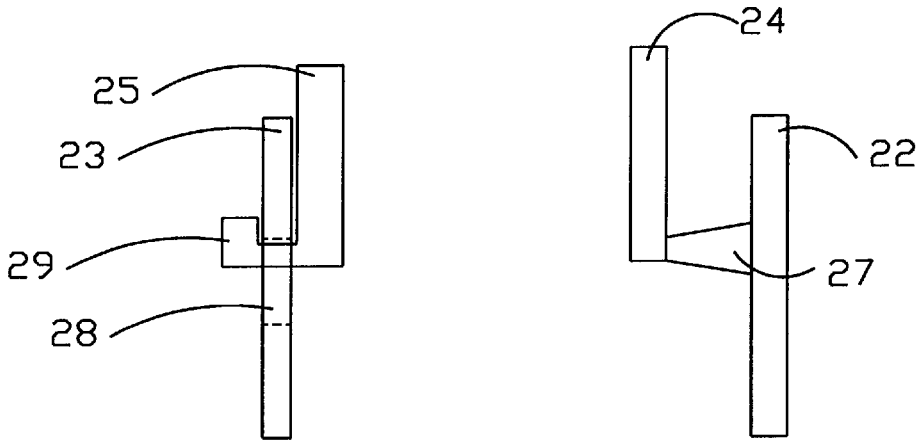
Figure 4C:
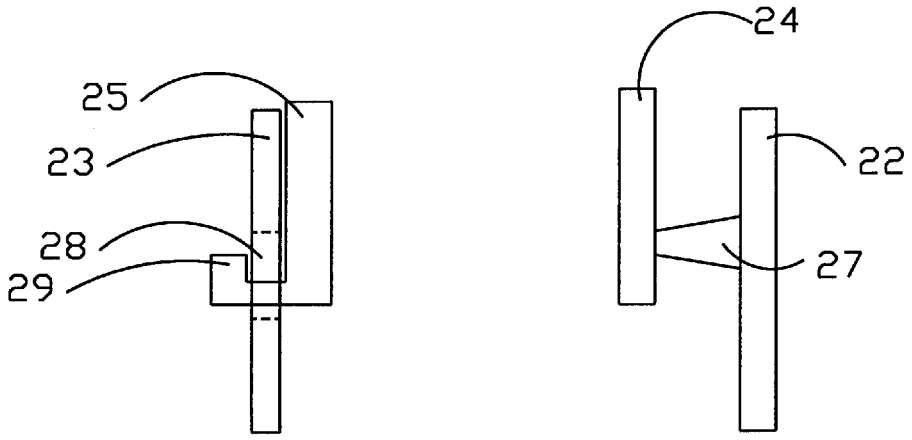

In order to detailed elucidate mechanism and combination process of the proposed hinge, FIG. 4A to FIG. 4C are employed to illustrate relative relation between first pair of structures and second pair of structures. Where FIG. 4A to FIG. 4C are cross-section figure of the proposed hinge but torsional spring does not be illustrated. FIG. 4A illustrates the relative relation when the proposed hinge is initially combined. FIG. 4B illustrates the relative relation when the proposed hinge is opened and FIG. 4C illustrate the relative relation when the proposed hinge is closed.

Referring to FIG. 4A and FIG. 2, because they illustrate the initially stage of combination process, torsional spring 26 is not transmuted and edge of third structure 24 only touches edge of first structure 22 and edge of fourth structure 25 also only touches edge of second structure 23. In other words, both third structure 24 does not contact bulge 27 and hook 29 does not hook on edge of concave portion 28 at the initially stage. In other words, owing to the fact that torsional spring 26 is not transfigured, there is no torque and then torsional spring can be easily attached to first apparatus 20 and second apparatus without any assistant tool. This is a main advantage for not only cost of assistant tool is saved but also combination process is simplified.

Referring to FIG. 4B and FIG. 2, they illustrate the stage that first apparatus 20 and second apparatus 21 are moved to each other until third apparatus 24 is just pushed by bulge 27. The stage is corresponding to opened stage of hinge, and torsional string 26 is compressed in the stage. No matter how, because the lever arm is adjusted and any apparatus can be used to form required lever arm, owing to the fact that torque is product of force and lever arm, it is obvious that combination process of proposed hinge is easy and labor-saving.

Obviously, because both third structure 24 and fourth structure 25 are fixed at second apparatus 21, not only third structure 24 is pushed away first structure 22 but also fourth structure 25 is pushed near to second structure 23. Beside, location of bulge 27, concave portion 28 and hook 29 is designed to let hook 29 hooks on concave portion 28. Therefore, and height of hook 29 must be larger than thickness of second structure 23. Moreover, depth of concave portion 28 must be larger than width of hook 29 otherwise hook 29 can not penetrate through concave portion 28 and hook on edge of concave portion 28.

Therefore, the opposite direction of elastic force of compressed torsional spring 26 will try to pull third structure 24 and fourth structure 25 back to the initially stage. No matter how, when hook 29 securely hooks on edge of concave portion 28, the relative relation between second structure 23 and fourth structure 25 is totally fixed for fourth structure 25 can not penetrate through second structure 23. In other words, the structure of the proposed hinge is secured and stable.

Referring to FIG. 4C and FIG. 2, they illustrate the stage that first apparatus 20 and second apparatus 21 are further moved to each other, where hook 29 moves along edge of second structure 23 and never hooks on second structure 23. Note that the stage is corresponding to the closed stage of hinge and torsional spring 26 is further compressed. In addition, obviously, third structure 24 still directly contacts with bulge 27. Thus, when external force is vanished, further compressed torsional spring 26 is relaxed and pull the second pair of structures back to the previous stage that correspond to opened stage of hinge.

No matter how, because third structure 24 still is pushed by bulge 27, hock 29 always penetrates through concave portion 28. Thus, it is almost impossible that hook 29 escapes from second structure 23 and induces an unexpected result that second pair of structures pulled to initially position and hinge is disintegrated. Therefore, the structure of the proposed hinge is further secured and stable.

As various possible embodiments may be made of the above invention without departing from the scope of the invention, it is to be understood that all matter herein described or shown in the accompanying drawings is to be interpreted as illustrate and not in a limiting sense. Thus, it will be appreciated that these drawings are exemplary of a preferred embodiment of this invention

What is claimed is:

1. A hinge for connecting two separate apparatuses that rotates around a common axis, comprising:

a first pair of structures that comprise a first structure and a second structure, an end of said first pair of structures is fixed in a first apparatus;

a second pair of structures that comprise a third structure and a fourth structure, where an end of said second pair of structures is fixed in a second apparatus, and said second pair of structures locates between said first structure and said second structure, wherein said third structure is adjacent to said first structure and said fourth structure is adjacent to said second structure, said first pair of structures is directly coupled with said second pair of structures by a bulge which locates on said first structure and directly contacts with said third structure;

a torsional spring, an end of said torsional spring is fixed in said first structure, said second structure or said first apparatus, another end of said torsional spring is fixed in said third structure, said fourth structure of said second apparatus.

2. The hinge according to claim 1, wherein said bulge has a height which is larger than the thickness of said second structure.

3. The hinge according to claim 1, wherein a concave portion locates on a lateral side of said second structure, said lateral side being not close to or far away from said fourth structure.

4. A hinge for connecting two separate apparatuses that rotates around a common axis, comprising:

a first pair of structures that comprise a first structure and a second structure, an end of said first pair of structures is fixed in a first apparatus;

a second pair of structures that comprise a third structure and a fourth structure, where an end of said second pair of structures is fixed in a second apparatus, and said second pair of structures locates between said first structure and said second structure, wherein said third structure is adjacent to said first structure and said fourth structure is adjacent to said second structure, said second pair of structures is directly coupled with said first pair of structures by a hook which locates on said fourth structure and are used to hook said second structure;

a torsional spring, an end of said torsional spring is fixed in said first structure, said second structure or said first apparatus, another end of said torsional spring is fixed in said third structure, said fourth structure of said second apparatus.

5. The hinge according to claim 4, wherein said hook hooks on said second structure when said hinge is opened and then a relative position between said first apparatus and said second apparatus is fixed by said hinge.

6. The hinge according to claim 4, wherein said torsional spring is compressed when said hinge is opened and then said hook securely hooks on said second structure by an opposite direction elastic force of compressed torsional spring.

7. The hinge according to claim 4, when said hinge is closed then said torsional spring is further compressed and said hook does not hook on said second structure.

8. A hinge for connecting two separate apparatuses that rotates around a common axis, comprising:

a first pair of structures that comprise a first structure and a second structure, an end of said first pair of structures is fixed in a first apparatus;

a second pair of structures that comprising a third structure and a fourth structure, where an end of said second pair of structures is fixed in a second apparatus, and said second pair of structures locates between said first structure and said second structure, wherein said third structure is adjacent to said first structure and said fourth structure is adjacent to said second structure, moreover, said first pair of structures is directly coupled with said second pair of structures by a bulge which locates on said first structure and directly contacts with said third structure, besides, said second pair of structures is directly coupled with said first pair of structures by a hook which locates on said fourth structure and are used to hook said second structure;

a torsional spring, an end of said torsional spring is fixed in said first structure, said second structure or said first apparatus, another end of said torsional spring is fixed in said third structure, said fourth structure of said second apparatus.

9. The hinge according to claim 8, wherein height of said bulge is larger than thickness of said second structure.

10. The hinge according to claim 8, wherein a concave portion locates on a lateral side of said second structure, said later side being not closed to or far away said fourth structure.

11. The hinge according to claim 8, wherein depth of said concave portion must be larger than width of said hook.

12. The hinge according to claim 8, wherein said hook hooks on said second structure when said hinge is opened and then a relative position between said first apparatus and said second apparatus is fixed by said hinge.

13. The hinge according to claim 8, wherein said torsional spring is compressed when said hinge is opened and then said hook securely hooks on said second structure by an opposite direction elastic force of compressed torsional spring.

14. The hinge according to claim 8, when said hinge is closed then said torsional spring is further compressed and said hook does not hook on said second structure.

* * * * *